United States Patent [19]

Ritter

[11] Patent Number: 4,469,224

[45] Date of Patent: Sep. 4, 1984

[54] CARTON BLANK AND CARTON FOR A BICYCLE

[75] Inventor: Dale L. Ritter, St. Louis, Mo.

[73] Assignee: International Paper Company, New York, N.Y.

[21] Appl. No.: 512,840

[22] Filed: Jul. 11, 1983

[51] Int. Cl.[3] ..... B65D 85/68

[52] U.S. Cl. ..... 206/335; 206/591; 217/38; 229/37 R

[58] Field of Search ..... 206/303, 304, 319, 320, 206/326, 335, 521, 577, 586, 588, 590, 591, 592, 594, 418; 217/37, 38; 229/6 R, 16 R, 23 R, 15, 27, 37 E, 37 R

[56] References Cited

U.S. PATENT DOCUMENTS

| | | | |
|---|---|---|---|
| 1,585,684 | 5/1926 | Oppenheim | 206/586 |
| 2,273,544 | 2/1942 | Vandervort | 206/335 |
| 2,339,947 | 1/1944 | Reaume | 206/335 |
| 2,578,107 | 12/1951 | Thacker et al. | 206/592 |
| 2,629,487 | 2/1953 | Kells et al. | 206/335 |
| 2,636,600 | 4/1953 | Denton et al. | 206/306 |
| 2,847,152 | 8/1958 | Van Antwerpen | 206/592 |
| 2,877,942 | 3/1959 | Van Antwerpen | 206/591 |
| 2,978,163 | 4/1961 | Anderson | 206/586 |
| 3,056,536 | 10/1962 | Smith et al. | 206/586 |
| 3,158,307 | 11/1964 | Mayer | 229/37 R |
| 3,162,351 | 12/1964 | Rudofski | 229/37 R |
| 3,313,467 | 4/1967 | Anderskow et al. | 229/37 R |
| 3,361,330 | 1/1968 | Arneson | 206/418 |
| 3,519,190 | 7/1970 | Achermann et al. | 229/23 R |
| 3,708,101 | 1/1973 | McDanield | 206/591 |
| 3,929,225 | 12/1975 | Locke et al. | 206/335 |
| 4,149,634 | 4/1979 | Lewis et al. | 206/335 |
| 4,266,715 | 5/1981 | Garrison | 229/37 E |

*Primary Examiner*—George E. Lowrance
*Assistant Examiner*—Jimmy G. Foster
*Attorney, Agent, or Firm*—Walt Thomas Zielinski

[57] ABSTRACT

A blank for a carton for packing bicycles and other articles is formed from a rectangular piece of sheet material such as corrugated paperboard so as to save waste material. It is cut and scored so that it may be preliminarily formed into a tube to be shipped flat to the packager and, as it is being erected, so that integral portions and parts may be folded into strut columns extending from wall to wall in two directions to prevent the contained article from tilting or migrating inside the container during shipment and to strengthen the carton against the pressures of stacking and handling by clamp trucks and the like.

28 Claims, 8 Drawing Figures

CARTON BLANK AND CARTON FOR A BICYCLE

BACKGROUND OF THE INVENTION

This invention relates to a carton blank made of sheet material such as corrugated paperboard, a partially formed carton for shipment in flat condition to the packager and a completely erected carton made from the blank for packaging irregularly shaped articles such as partly disassembled bicycles.

The prior art is replete with disclosures of corrugated paperboard cartons designed for this purpose. They all have disadvantages of one kind or another which the design according to the present invention overcomes.

A primary objective of good carton design is to avoid waste as much as possible. This is accomplished by using, for the most part, a piece of sheet material having a rectangular shape and using it in its entirety for making the container blank and forming the container and all its parts without having to cut away certain portions which then become waste, leaving an irregularly shaped blank.

A long high and narrow carton such as is required for packaging a bicycle has inherent weaknesses. Internal strengthening is needed so that the carton and its contents are able to withstand the pressures of stacking and handling by clamp trucks and the like during storage and shipping. Accordingly, internal bracing has been embodied in the carton design for such packaging, usually of the paperboard sheet material which is used for the body of the carton itself, folded into various shapes to form strengthening struts.

At the same time it is desirable to form padding to keep the bicycle parts or other contents of the carton from tilting or migrating inside the container during the shipment. Accordingly, the internal bracing provided is often arranged to perform that function also.

While a standard carton design without the internal bracing and padding has long been made out of a rectangular shape, it is difficult to incorporate into such a rectangle portions and parts which are integral with the carton blank and which can also be arranged to provide the internal bracing and padding necessary, particularly in order to provide bracing and padding in two directions within the box.

Accordingly, most of the prior container designs have used inserts for the strengthening and padding or cushioning parts which are separate from and not integral with the carton blank itself. When such internal strengthening and padding parts have been incorporated into the carton blank as integral parts, the basic carton blank shape is no longer rectangular, therefore causing waste, the bracing and padding does not run in two directions between walls of the cartons or if it does, the bracing or strut columns do not fully extend from wall to wall within the carton.

The carton manufacturer wants to be able to form the carton blank into a collapsible tube which he can ship flat to his customer, the packager, who will then erect the tube-formed blank into, the carton in which he will package his goods. If the carton blank is an irregular shape and particularly if it also requires extra parts as inserts, the, carton manufacturer has problems and complications which he would not have if he could ship a simple rectangular blank which has first been formed with a manufacturers joint into a flattened tube. And his customer, the packager, does not want to have to be bothered with separate inserts which, unless they are fastened to the interior of the erected carton, will drift around inside it.

Accordingly, it is the general object of this invention to provide an economical, i.e., wasteless paperboard carton blank which has integral parts which can be formed into internal strut columns, and pads extending in two different directions fully from wall to wall within the carton as the latter is being erected by the package. Another object is to provide integral locking means by which parts of the blank when folded over with respect to each other to form strut columns may be easily and quickly interlocked so as to remain in place within the carton during its life as a package for its enclosed contents.

SUMMARY OF THE INVENTION

The carton blank of the invention for packaging articles of irregular shape such as partly disassembled bicycles is formed, including its integral strut parts, from a single rectangular piece of sheet material such as corrugated paperboard. The piece forming the blank includes, in order, from one end to the other of the piece, a first partial back wall portion which has an outer vertical edge which preferably has glue strip for securing it to the outer edge part of a second partial back wall portion, an end wall portion, a front wall portion, another end wall portion and the aforementioned second partial back wall portion having the outer edge part. These wall portions have vertical score lines between them and they are thereby foldable with respect to each other along these score lines. They also include top flaps and bottom flaps for forming the top and bottom of the carton and these flaps are separated from their respective adjacent wall portions by co-linear horizontal score lines, that is score lines which lie along single lines when the blank is laid out flat. The second partial back wall portion has three tongue portions which are separated from each other by cuts extending outwardly from the outer edge part of the second partial back wall portion in line with the respective horizontal score lines thus forming a center tongue portion and two outer tongue portions.

At least one and preferably each of the three tongue portions has multiple vertical score lines for folding the parts of the tongue portion between the score lines into a strut column extending fully between two of the walls of the container during the latter's erection. The strut formed by the center tongue portion forms a strut column between the top and bottom of the container and it is also designed so that it provides a tube that is big enough to contain within the carton one or more of the parts of the article packaged in the container.

During the erection of the box the parts of the two outer tongue portions are folded between their vertical score lines into horizontal strut columns which extend fully between the front and back walls of the container at its top and bottom. The three tongues also have locking tabs for securing their parts together within the container during its packaging life.

While being erected, the vertical strut column parts are folded and locked, the bottom horizontal strut column parts are folded and locked and the bottom wall flaps are folded. Then the article to be packaged such as the bicycle and its parts are inserted from the top. Then the top strut column parts are folded and locked and then the top wall parts are folded. Finally, the top and bottom wall flaps are glued as bypassing the container through a side sealer.

DETAILED DESCRIPTION OF THE INVENTION

Figure 1:
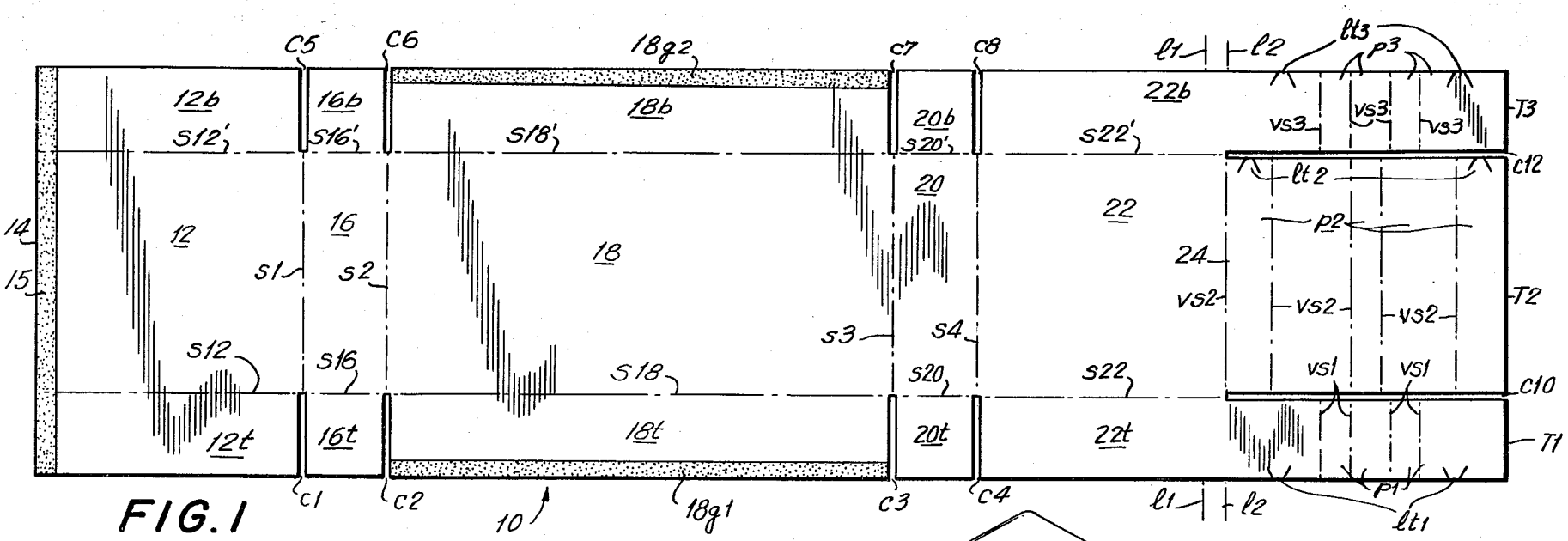
FIG. 1 is a view of the container blank of the invention laid out flat, upside down and inside up as viewed.
Figure 2:
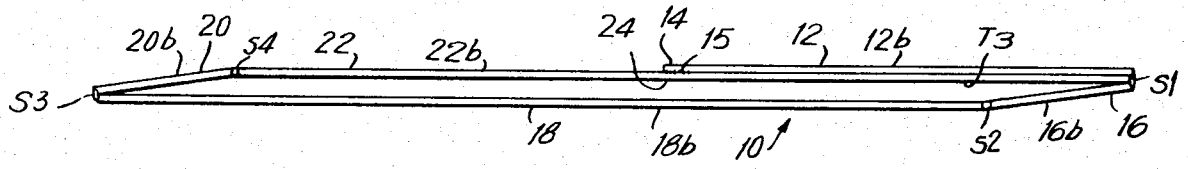
FIG. 2 is an edgewise view of the blank of FIG. 1 with its bottom toward the viewer and with its vertical edge parts fastened by a manufacturer's joint into a not quite flattened condition substantially in condition for shipment to the packager.

A container blank of the invention is indicated at 10 in FIGS. 1 and 2. It becomes the container indicated at C in FIG. 8. The blank is rectangular in shape and formed of sheet material, preferably corrugated paperboard. Except for the little bit removed to form eight cuts, all of it is used to form the internal as well as the external parts of the container for irregularly shaped articles such as bicycles, so there is no waste. In FIG. 1, the blank is shown with its bottom parts up so as to correspond with FIG. 3 which shows erection of the container at its bottom.

As seen, and proceeding in order from one end to the other of this blank piece, it has a first partial or one half back wall portion 12 which has an outer vertical edge 14 including a glue strip 15 by which the carton manufacturer forms a manufacturer's joint, an end wall portion 16, a front wall portion 18, another end wall portion 20 and a second partial or one half back wall portion 22 having an outer edge part 24 defined by the area between the line 1 1 and 1 2.

The wall portions 12, 16, 18, 20 and 22 have vertical score lines between them indicated at s1, s2, s3 and s4 so that they are foldable with respect to each other. These wall portions 12, 16, 18, 20 and 22 also include top flaps **12*t*, 16*t*, 18*t*, 20*t* and 22*t* and bottom flaps 12*b*, 16*b*, 18*b*, 20*b* and 22*b***.

The top flaps **12*t*, 16*t*, 18*t*, 20*t* and 22*t* and bottom flaps 12*b*, 16*b*, 18*b*, 20*b* and 22*b* are separated from their respective adjacent wall portions by co-linear horizontal score lines s12, s16, s18 s20 and s22 at the top and s12', s16', s18', s20' and s22' at the bottom. The express co-linear means that these horizontal score lines at the top and at the bottom respectively are all in line when the blank is laid out flat as seen in FIG. 1** even though they are no longer in line when the blank is formed into a tube by the manufacturer and then into a container by the packager.

The top flaps **12*t*—22*t* are separated from each other respectively by cuts c1, c2, c3, and c4 and the bottom flaps 12*b*—22*b* are separated from each other respectively by cuts c5, c6, c7 and c8**.

The top and bottom lengthwise flaps **18*t* and 18*b* each have glue stips 18g1 and 18g2** for securing the container closed.

The second partial back wall portion 22 has three tongue portions T1, T2 and T3, separated from each other by cuts c1O and c12. These cuts c10 and c12 extend outwardly from the outer edge part 24 of the partial back wall portion 22 in line with the horizontal score lines s22 and s22'. Each of the outer tongues T1 and T3 has four vertical score lines indicated at vs1 and vs3 respectively. The center tongue T2 has five vertical score lines indicated at vs2. The multiple vertical score lines vs1 and vs3 are for folding the parts indicated as p1 and p3 of the outer tongue portions T1 and T3 into top and bottom strut columns 30 and 32 extending between the front and back walls of the container as to be further described. The multiple vertical score lines vs2 are for folding the parts indicated at p2 of the center tongue T2 between the vertical score lines vs2 into a vertical strut column 34 extending substantially fully between the top and bottom walls of the erected container as to be further described. Each of the three tongues T1, T2 and T3 has locking tabs indicated at 1t1, 1t2, and 1t3 for locking the respective parts p1, p2 and p3 after they have been folded into the above mentioned respective column struts.

In partially erecting the blank 10 into a container for flat shipment to the packager who will use it, as seen in FIG. 2, the first partial back wall portion 12, the end wall portion 16, the front wall portion 18 and the end wall portion 20 are folded around their respective vertical score lines s1, s2, s3 and s4 (only their bottom flaps **12*b*, 16*b*, 18*b*, 20*b* and 22*b* being seen in FIG. 2) so that the back wall portion 12 is brought around outside of the tongue, T1, T2 and T3 (only the bottom tongue T3 being seen in FIG. 2) so that the outer vertical edge 14 of the back wall portion 12 may be secured to the outer edge 14 and glue strip 15 over and in contact with the edge part 24 which is between the lines 1 1 and 1 2 in FIG. 1. Thus the wall portions of the carton blank 10 are formed into a collapsed tube for shipment from the manufacturer to the packager. For clarity, the wall portions (only their bottom flaps being seen in FIG. 2**) are indicated as not completely collapsed, and just before they are laid flat for shipment.

Figure 3:
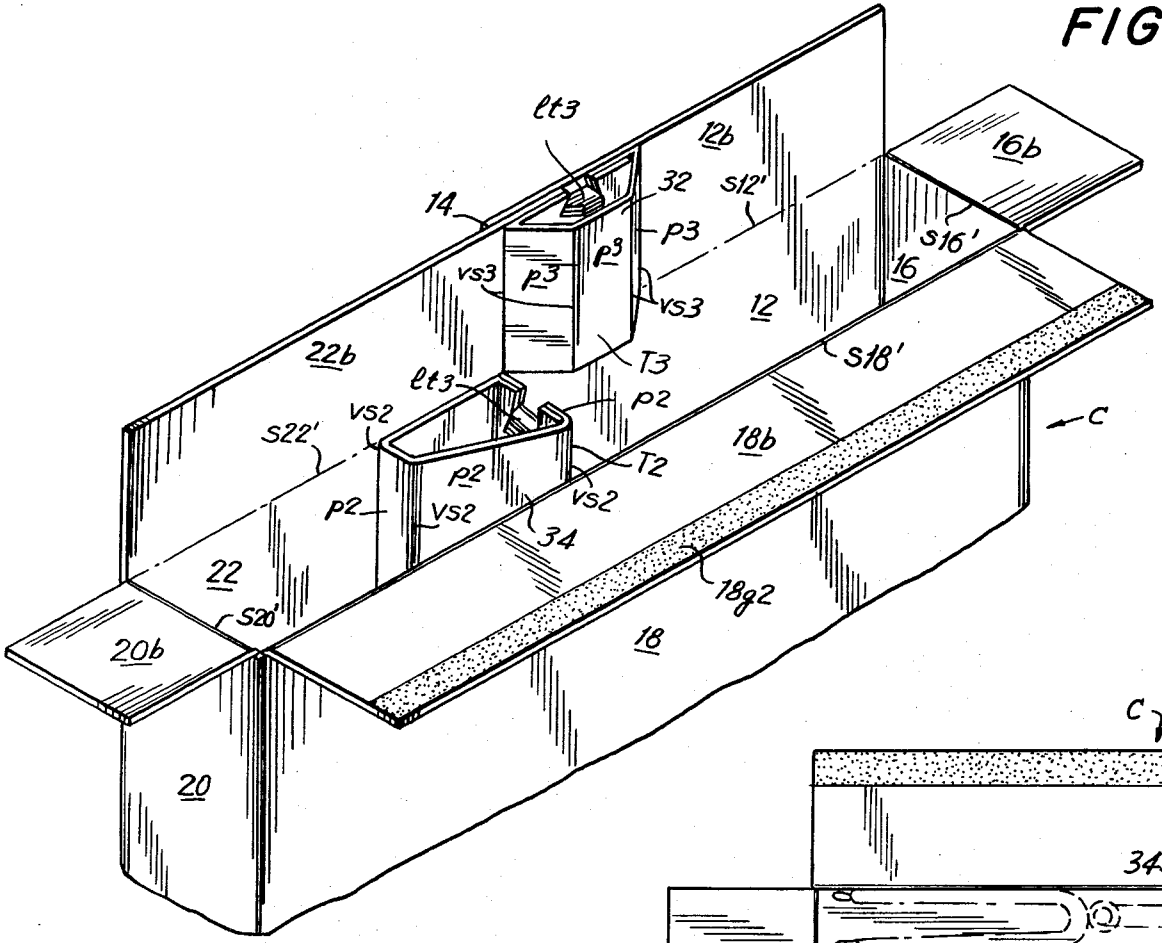
FIG. 3 is a partial perspective view from above showing the bottom of the container and its internal structures formed before the bottom flaps are closed.

When he is ready to fill the container with articles such as bicycle parts for shipment, the packager first erects the blank wall portions into a squared up condition so that it begins to look like a container indicated at C as seen in FIG. 3.

Since the packager must first erect and close the bottom of the box before filling it, FIG. 3 shows the container C bottom up with two 32 and 34 of the three internal struts formed by folding and locking their parts together and just before closure of the bottom.

After squaring up the box, the parts p2 of the center tongue portion T2 are folded around their vertical score lines vs2 to form the vertical strut column 34 which extends fully, except for the half widths of the cuts c10 and c12, between the top and bottom walls of the container after it has been closed.

Then the parts p3 of the bottom outer tongue portion T3 are folded around their vertical score lines vs3 to form the bottom strut column 32 which is locked in place with the locking tabs 1t3. Then the bottom flaps **12*b*, 16*b*, 18*b*, 20*b* and 22*b* are folded into closed position for later sealing by passing the filled container through a side sealer machine. Or at this time the bottom wall may be sealed by wetting the glue strip 18g2**.

The horizontal bottom strut column 32 will now extend fully between the front and back walls 18 and 12 of the carton except for the half width of the cut c12. In effect the strut column 32 will be in contact with these front and back walls.

Now the carton C is turned right side up and filled with articles to be packaged such as bicycle parts Bp1, Bp2 and Bp3.

Figure 4:
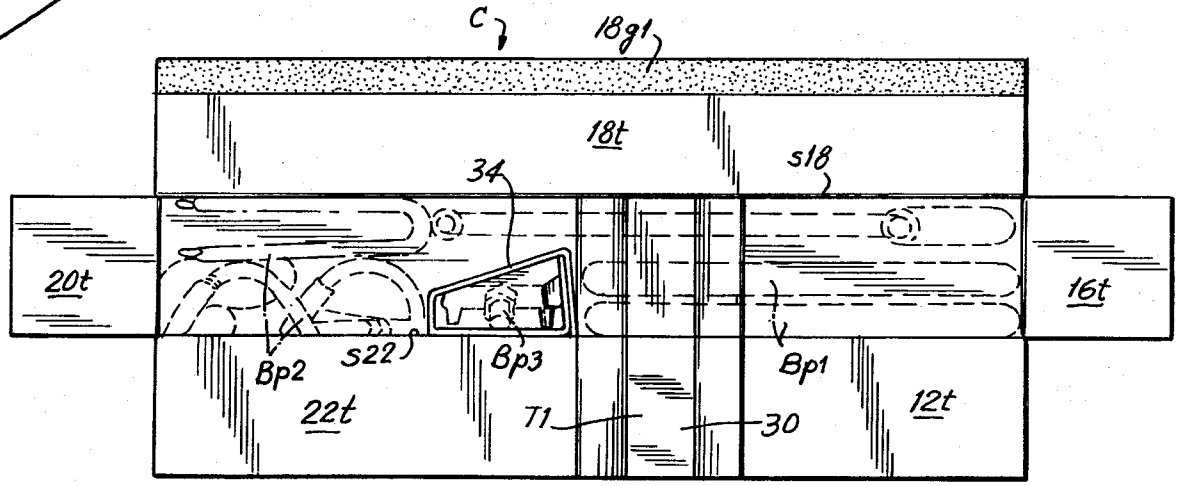
FIG. 4 is a top plan view of the container into which has been packaged bicycle parts for shipment, prior to closure of the top flap.
Figure 7:
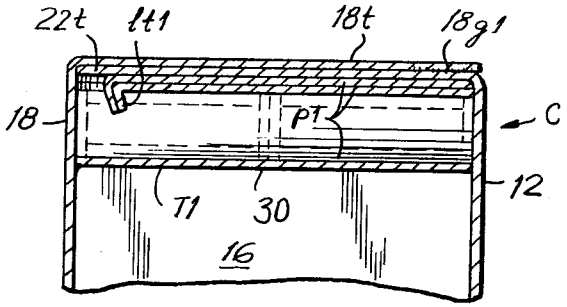
FIG. 7 is a partial cross section view taken along the line 7—7 of FIG. 6 showing a horizontal strut column at the top of the container.
Figure 5:
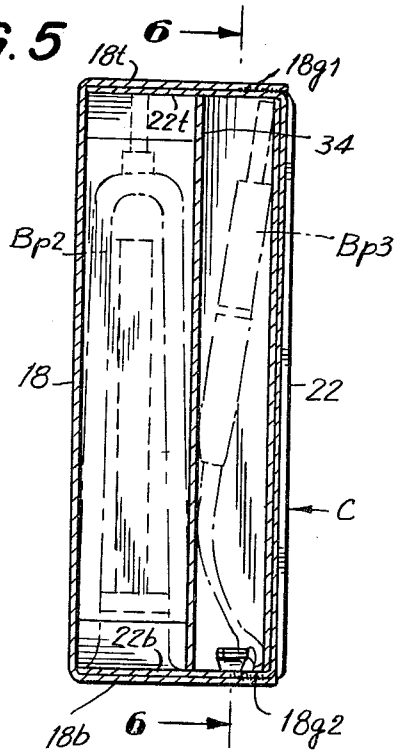
FIG. 5 is a cross section view of the container taken along the line 5—5 of FIG. 8 with the packaged contents indicated.

Then the parts pl of the top outer tongue portion T1 are folded around their vertical score lines vs1 to form a top horizontal strut column 30 as seen in FIG. 4 along the top flap of the carton which is formed by the flaps **12*t* and 22*t* of the partial back wall portions 12 and 22. The parts p1 of the top tongue T1 forming the top horizontal strut column 34 are locked together in place by the locking tabs lt1 as seen in FIG. 7**.

Figure 8:
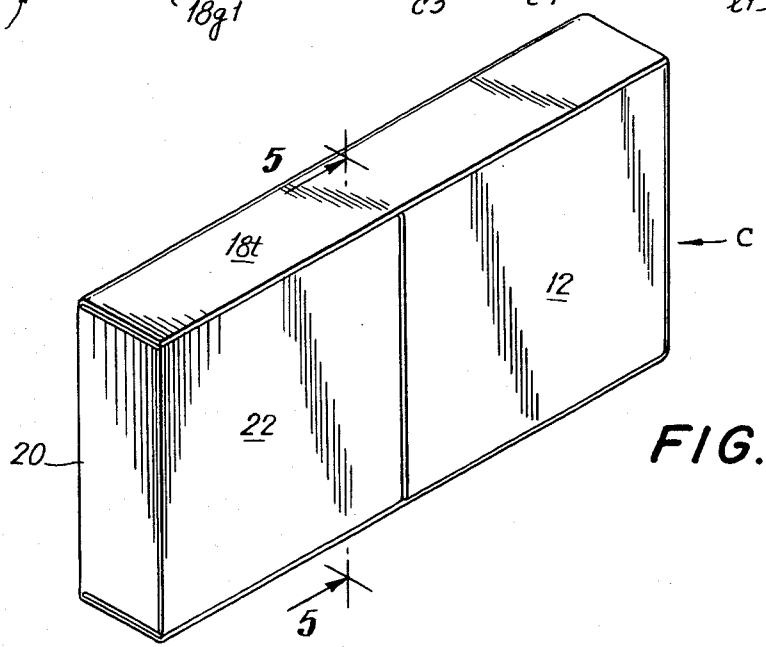
FIG. 8 is a perspective view of the container from its back side after it has been erected, filled with bicycle parts and closed.

Finally, the top flaps **16*t*, 18*t*, 20*t* and 22*t* —12*t* are folded over to form the top wall and sealed as by the glue strip 18g1 so that the carton now appears as in FIG. 8**.

Figure 6:
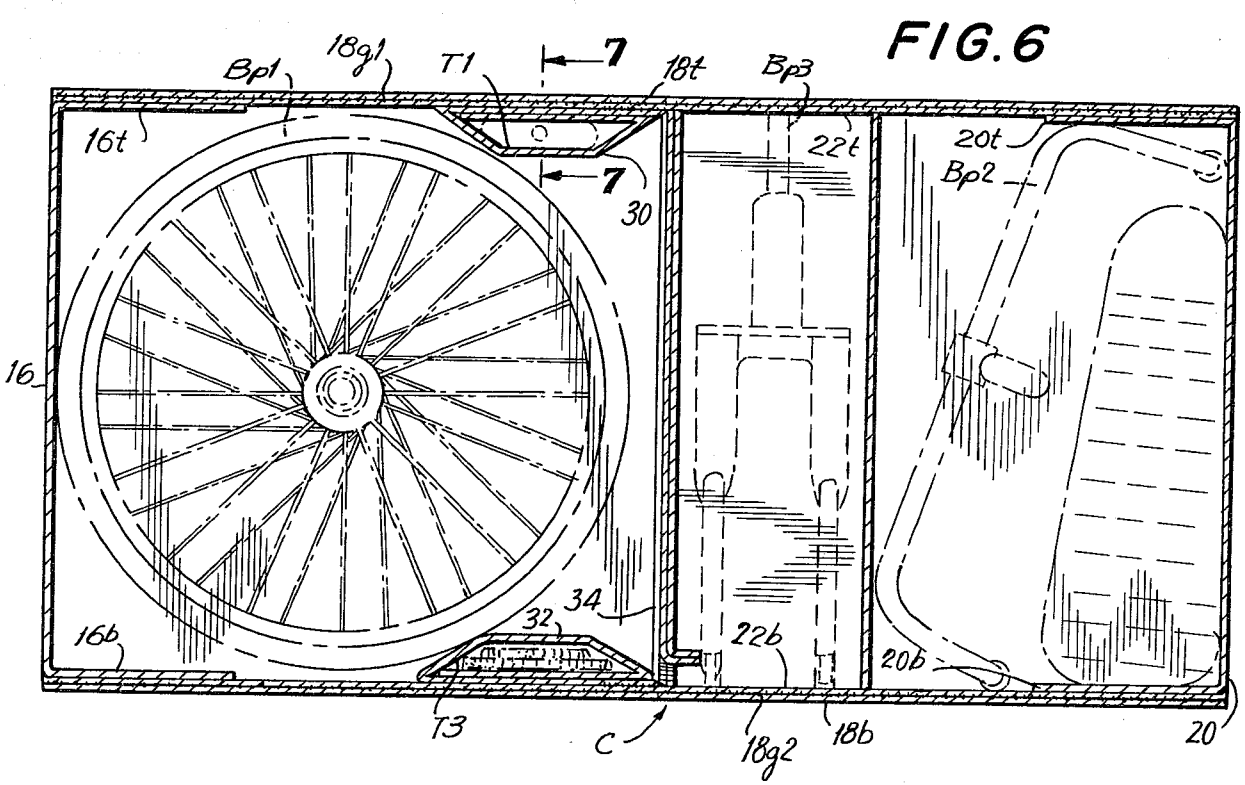
FIG. 6 is a longitudinal cross section view of the container taken along the line 6—6 of FIG. 5 indicating packaged bicycle parts enclosed in the container.

As seen in FIG. 4 and 6, the article parts Bp1 may be bicycle wheels which are held secure in the carton by the horizontal strut columns 32 and 34. Article parts Bp2 such as a bicycle handlebar and a fork are remotely in the other end of the carton as best seen in FIG. 4. Other parts Bp3 such as another bicycle fork can be secured inside the vertical column 30 as best seen in FIG. 4.

There is thus provided by this invention a carton useful for packaging bicycles and other odd shaped articles which has reinforcing strut columns extending fully between container walls in two directions in that the vertical strut column 30 supports the container between its top and bottom walls while the horizontal strut columns 32 and 34 support it against side pressure between its front and back walls. These features are formed as integral parts and without waste using all of the materials of a rectangular carton blank.

What is claimed is:

1. A carton blank for constructing a container, said blank being formed from a piece of sheet material having a substantially rectangular shape, and including, in order, from one end to the other of said piece, a first partial back wall portion having an outer vertical edge, and end wall portion, a front wall portion, another end wall portion and a second partial back wall portion having an outer edge part, said portions having vertical score lines between them and being foldable with respect to each other along said vertical score lines and all including top flaps and bottom flaps separated from their respective adjacent portions by co-linear horizontal score lines, the outer edge of said first partial back wall portion being securable to the outer edge part of the second partial back wall portion, said second partial back wall portion having three tongue portions separated by cuts extending outwardly from said outer edge part in line with said horizontal score lines, and at least one of said tongue portions having multiple vertical score lines for folding parts of said tongue portion between said vertical score lines into a strut column extending fully between walls of the said container.

2. A carton blank according to claim 1 in which the sheet material is corrugated paperboard.

3. A carton blank according to claim 1 in which the center tongue portion of the said three tongue portions has the said multiple vertical score lines for folding its said parts between said vertical score lines into a vertical strut column extending fully between top and bottom walls of the said container.

4. A carton blank according to claim 3 in which the said parts of the said center tongue portion have locking tabs for interlocking them with each other after they have been folded into a said vertical strut column.

5. A carton blank according to claim 3 in which the said center tongue portion has five vertical score lines providing five foldable parts.

6. A carton blank according to claim 1 in which at least one of the two outer portions of the said three tongue portions has the said multiple vertical score lines for folding its said parts between vertical score lines into a horizontal strut column extending fully between front and back walls of the said container.

7. A carton blank according to claim 6 in which the said parts of the said at least one outer tongue portion have locking tabs for interlocking them with each other after they have been folded into the said strut column.

8. A carton blank according to claim 6 in which the said at least one outer tongue portion has four vertical score lines providing four foldable parts.

9. A carton blank according to claim 1 in which the said first partial back wall portion and the said second partial back wall portion each forms substantially one half of the back wall of a said container.

10. A carton blank according to claim 1 in which the said outer vertical edge of the said first partial back wall portion has a glue strip for securing it to the said outer edge part of the said second partial back wall portion.

11. A carton blank according to claim 1 in which at least one of the said top flaps and bottom flaps has a glue strip for securing it to an adjacent flap of a said container.

12. A partially formed container capable of assuming a flat condition and made from a blank according to claim 1 by securing the said outer vertical edge of the said first partial back wall protion to the said outer edge part of the said second partial back wall protion.

13. A container constructed from a blank formed according to claim 1.

14. A container constructed from a blank formed according to claim 2.

15. A container constructed from a blank formed according to claim 3.

16. A container constructed from a blank formed according to claim 4.

17. A container constructed from a blank formed according to claim 5.

18. A container constructed from a blank formed according to claim 6.

19. A container constructed from a blank formed according to claim 7.

20. A container constructed from a blank formed according to claim 8.

21. A container constructed from a blank formed according to claim 9.

22. A container constructed from a blank formed according to claim 10.

23. A container constructed from a blank formed according to claim 11.

24. A container constructed from a blank formed according to claim 12.

25. A container constructed from a blank formed according to claim 13.

26. A container formed from a corrugated paperboard blank having a rectangular shape said container including a front wall, a back wall, end walls and top and bottom walls, a portion of the back wall originally including three integral horizontally extending tongue portions each having multiple vertical score lines defining parts of the tongue portions, the said parts of the outer two of the said tongue portions being folded into respective top and bottom horizontal strut columns extending fully between said front and back walls, the said parts of the center portion of said tongue portions being folded into a vertical strut column extending fully between said top and bottom walls.

27. A carton according to claim 26 in which the said tongue portions have locking tabs for locking their said parts in place with respect to each other to maintain the strut columns in place within the container.

28. A container according to claim 26 in which the said vertical strut column is shaped so as to have a hollow interior capable of receiving some of the total of the articles packaged in said container.

* * * * *